US012799738B2

(12) United States Patent
Davis

(10) Patent No.: US 12,799,738 B2
(45) Date of Patent: Nov. 17, 2026

(54) MODULAR DECKING SYSTEM

(71) Applicant: Kirk Davis, Beachland (NZ)

(72) Inventor: Kirk Davis, Beachland (NZ)

( * ) Notice: Subject to any disclaimer, the term of this patent is extended or adjusted under 35 U.S.C. 154(b) by 106 days.

(21) Appl. No.: 18/832,871

(22) PCT Filed: Mar. 21, 2023

(86) PCT No.: PCT/IB2023/000147
§ 371 (c)(1),
(2) Date: Jul. 24, 2024

(87) PCT Pub. No.: WO2023/187467
PCT Pub. Date: Oct. 5, 2023

(65) Prior Publication Data

US 2025/0129607 A1 Apr. 24, 2025

Related U.S. Application Data

(60) Provisional application No. 63/325,644, filed on Mar. 31, 2022.

(51) Int. Cl.
*E04C 3/07* (2006.01)
*E04C 3/04* (2006.01)

(52) U.S. Cl.
CPC ..... *E04C 3/07* (2013.01); *E04C 2003/0417* (2013.01); *E04C 2003/0434* (2013.01); *E04C 2003/0473* (2013.01)

(58) Field of Classification Search
CPC ..... E04B 1/003
See application file for complete search history.

(56) References Cited

U.S. PATENT DOCUMENTS

| | | | | |
|---|---|---|---|---|
| 2,405,535 | A * | 8/1946 | Weiss | B65D 19/38 206/386 |
| 2,909,350 | A * | 10/1959 | Morris | B65D 19/0097 108/54.1 |
| 4,691,484 | A * | 9/1987 | Wilson | E04B 1/34315 52/79.5 |
| 7,500,335 | B1 * | 3/2009 | Kjose | E04H 3/28 52/79.5 |
| 8,141,683 | B1 * | 3/2012 | Wurth | E04G 1/367 182/223 |
| 9,731,739 | B2 * | 8/2017 | Marler | A47B 91/002 |
| 9,809,970 | B2 | 11/2017 | Burns | |
| 2010/0071141 | A1 * | 3/2010 | Reiner | E04G 11/56 52/848 |

FOREIGN PATENT DOCUMENTS

EP 2434073 B1 8/2021

* cited by examiner

*Primary Examiner* — Babajide A Demuren
(74) *Attorney, Agent, or Firm* — Anderson Patent Law Firm

(57) ABSTRACT

A modular decking system comprising at least one extendable joist, at least two extendable beams each connected to the at least one extendable joist, and at least one extendable bearer supporting the at least one extendable joist and the at least two extendable beams. The at least one extendable bearer is connected to the at least one extendable joist. Each extendable joist, each extendable beam, and each extendable bearer are extendable and retractable relative to one another.

13 Claims, 15 Drawing Sheets

MODULAR DECKING SYSTEM

CROSS-REFERENCE TO RELATED APPLICATIONS

This application claims benefit of U.S. provisional patent application Ser. No. 63/325,644, entitled, "MODULAR DECKING SYSTEM", filed Mar. 31, 2022, which is herein incorporated by reference in its entirety.

BACKGROUND

The present disclosure relates to decking, and more specifically, to a modular decking system.

Traditional decking systems comprise wooden beams which are connected together with fasteners. Almost all traditional decking systems are constructed of timber. Such wooden decking systems are heavy to move, bulky to store and deliver, and require advanced expertise to design, measure, cut, and assemble into a deck. This takes a considerable amount of time and leaves a large percentage of waste, all of which adds cost and impacts on the environment. The very nature of the traditional systems means that the DIY market is excluded from the ability to install a deck, given the significant knowledge, tools, and equipment that are required to construct a deck.

SUMMARY

In one exemplary embodiment, there is provided a modular decking system constructed of light gauge steel that can be used for decking, paths, jetties, boardwalks, platforms, and small crossings such as pedestrian bridges and the like. The decking system can be pre-printed from a custom machine into a very limited number of components, that can then be assembled into a deck of any size without any cutting or drilling of components. The modular decking system comprises a plurality of light gauge steel extendable joists that are connected to a plurality of light gauge steel extendable beams, being carried by one or more light gauge steel extendable bearer members. The bearer members in turn are supported at or above ground level by one or more light gauge steel extendable foundation posts, none of which need to be cut or drilled. The reference to the extendable joists, beams, bearers and posts is intended to define a form of engagement between the printed components in their assembly as a module to allow for a considerable degree of adjustment during construction. In turn, this allows multiple modules to be combined to make a deck of unlimited size constraint, without the need for cutting or drilling.

In another exemplary embodiment, a modular decking system is provided. The modular decking system comprises at least one extendable joist, at least two extendable beams each connected to the at least one extendable joist, and at least one extendable bearer supporting the at least one extendable joist and the at least two extendable beams. The at least one extendable bearer is connected to the at least one extendable joist. Each extendable joist, each extendable beam, and each extendable bearer are extendable and retractable relative to one another.

According to one aspect of the present disclosure, each extendable joist, each extendable beam, and each extendable bearer are configured to move relative to one another for setting an overall size of the modular decking system.

According to another aspect of the present disclosure, each extendable joist, each extendable beam, and each extendable bearer are configured to define an overall size of the modular decking system without cutting or drilling by an assembler.

According to another aspect of the present disclosure, the at least one extendable joist comprises a first joist member and a second joist member disposed within and movable relative to the first joist member, and the second joist member is configured for extending a length of the at least one extendable joist.

According to another aspect of the present disclosure, the second joist member comprises a first-joist-member facing surface and a joist recessed channel in the first-joist-member facing surface, and the joist recessed channel is configured to reduce friction between the second joist member and the first joist member.

According to another aspect of the present disclosure, the at least two extendable beams each comprise a first beam member and a second beam member disposed within and movable relative to the first beam member, and the second beam member is configured for extending a length of each extendable beam.

According to another aspect of the present disclosure, the second beam member comprises a first-beam-member facing surface and a beam recessed channel in the first-beam-member facing surface, and the beam recessed channel is configured to reduce friction between the second beam member and the first beam member.

According to another aspect of the present disclosure, the at least one extendable bearer comprises a first bearer member and a second bearer member disposed within and movable relative to the first bearer member, and the second bearer member is configured for extending a length of the at least one extendable bearer.

According to another aspect of the present disclosure, the second bearer member comprises a first-bearer-member facing surface and a bearer recessed channel in the first-bearer-member facing surface, and the bearer recessed channel is configured to reduce friction between the second bearer member and the first bearer member.

According to another aspect of the present disclosure, the modular decking system further comprises at least one extendable post configured to be fixed to the ground, the at least one extendable post is connected to the at least one extendable bearer.

According to another aspect of the present disclosure, the at least one extendable post comprises a first post member fixed to the ground and a second post member disposed within and movable relative to the first post member.

According to another aspect of the present disclosure, the second post member comprises a first-post-member facing surface and a post recessed channel in the first-post-member facing surface, and the post recessed channel is configured to reduce friction between the second post member and the first post member.

According to another aspect of the present disclosure, each extendable beam comprises at least one locating member configured to locate and receive the at least one joist therein.

According to another aspect of the present disclosure, each locating member of each extendable beam comprises a cutout in the extendable beam.

The present disclosure also provides a method. The method includes an initial step of providing a modular decking system. The modular decking system comprises at least one extendable joist, at least two extendable beams, and at least one extendable bearer. The method further includes connecting the at least one extendable joist to each extendable beam and connecting the at least one extendable joist to the at least one extendable bearer such that the at least one extendable bearer supports the at least one extendable joist and the at least two extendable beams. The method further includes setting an overall size of the modular decking system by extending or retracting each extendable joist, each extendable beam, and each extendable bearer relative to one another.

BRIEF DESCRIPTION OF THE DRAWINGS

The embodiments illustrated herein are not limited to the precise arrangements, sequential steps, and dimensions shown. Like numerals indicate like elements throughout the drawings. In the drawings.

DETAILED DESCRIPTION

Figure 1:
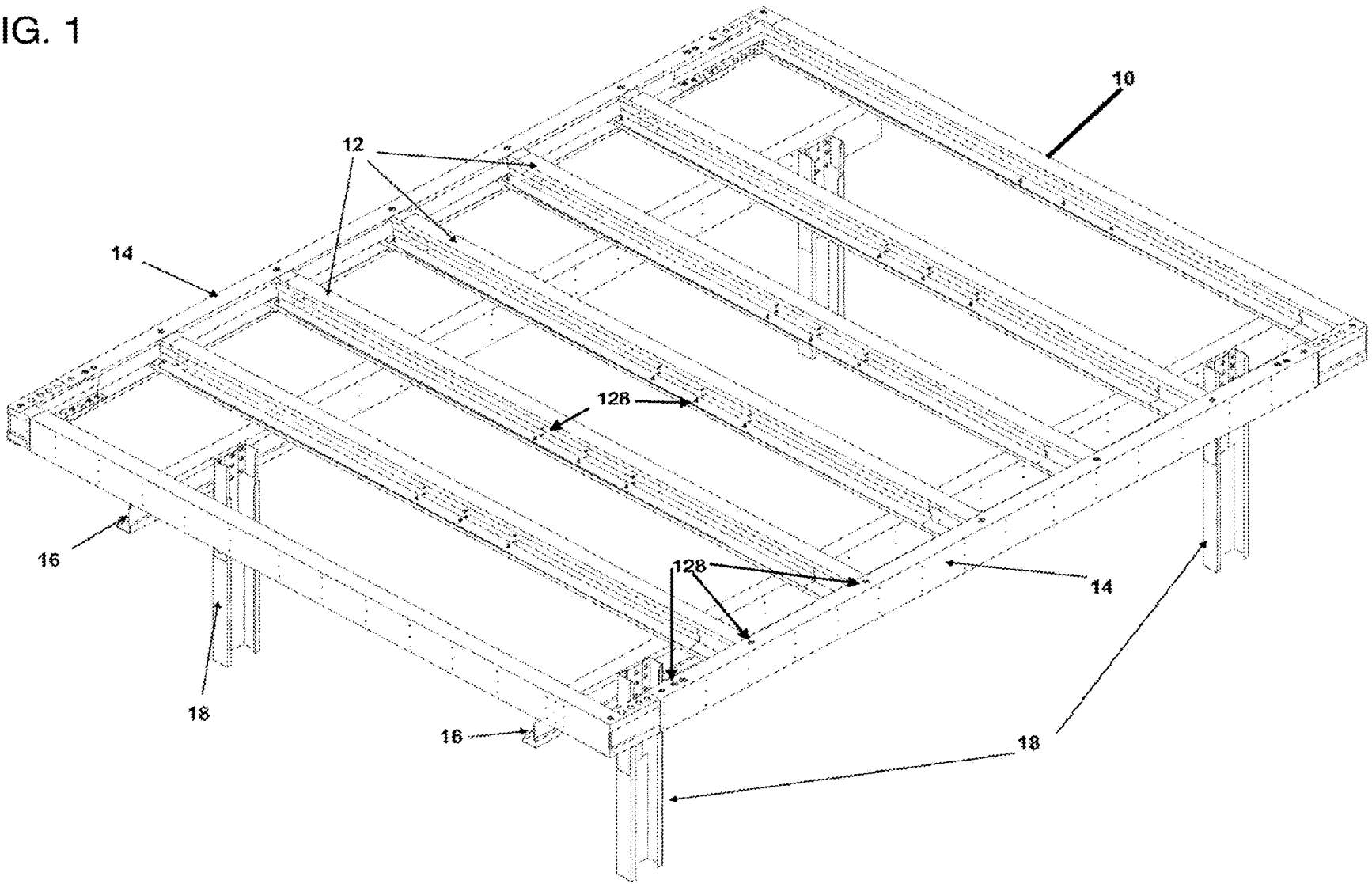
FIG. 1 illustrates a perspective view of a modular decking system, as assembled.
Figure 2:
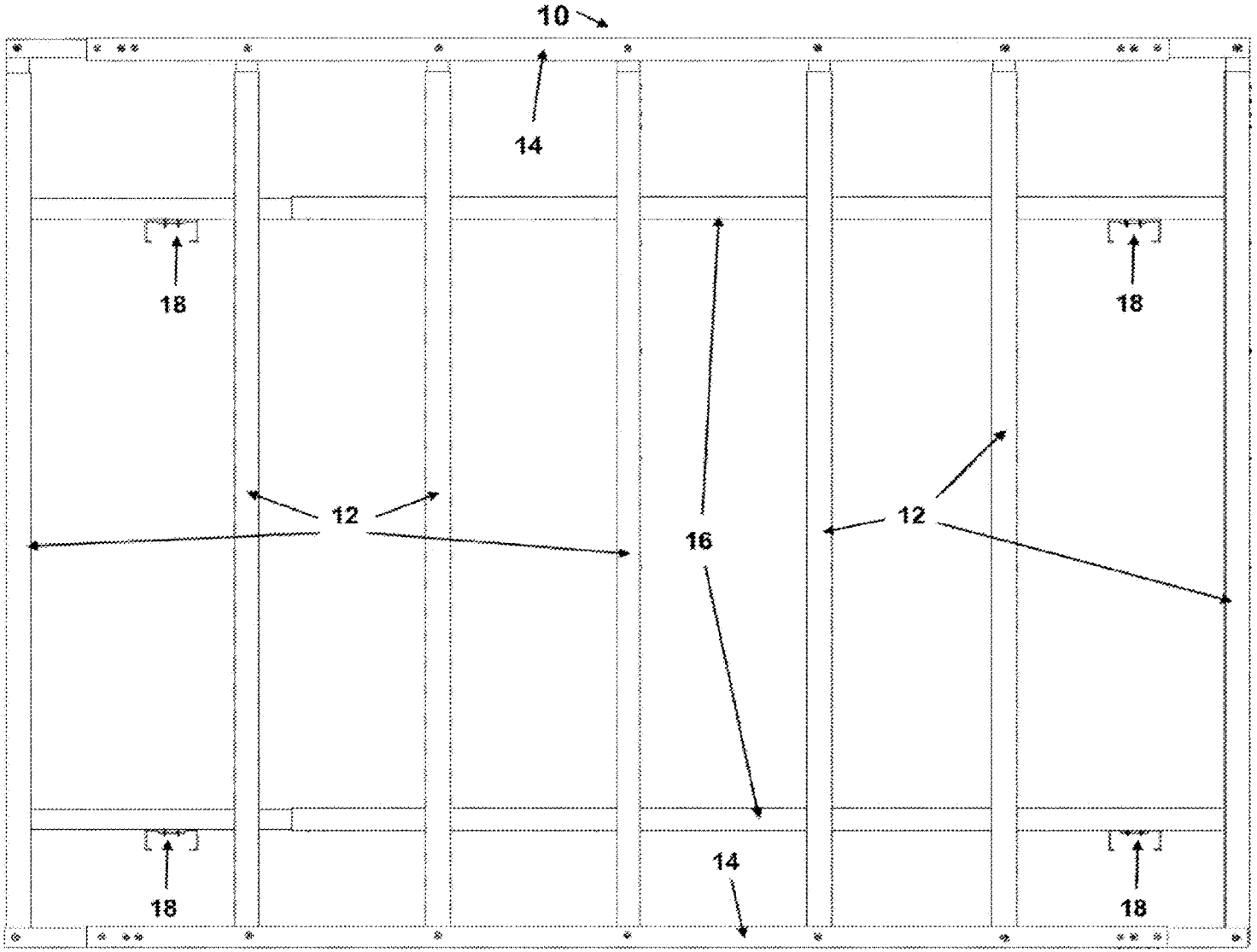
FIG. 2 illustrates a plan view of the modular decking system.
Figure 3:
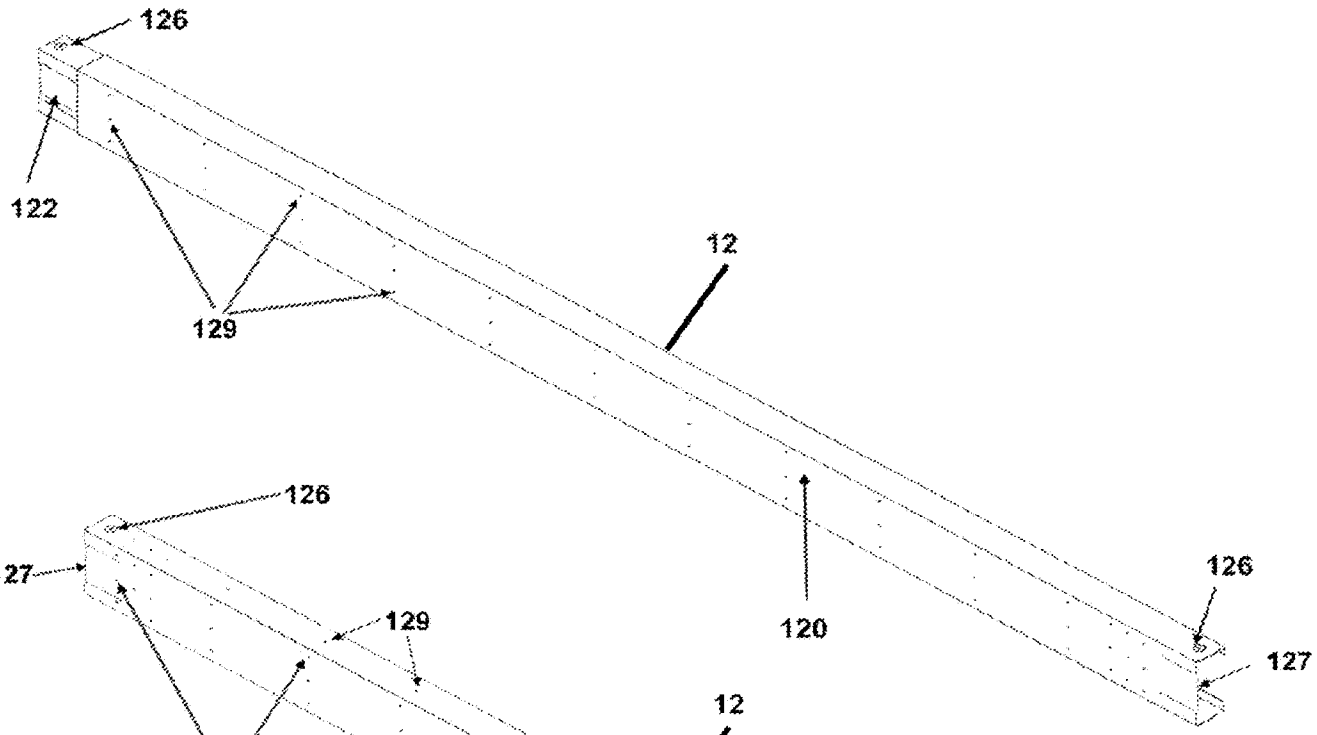
FIG. 3 is a perspective view of the extendable joist and its components when assembled.
Figure 4:
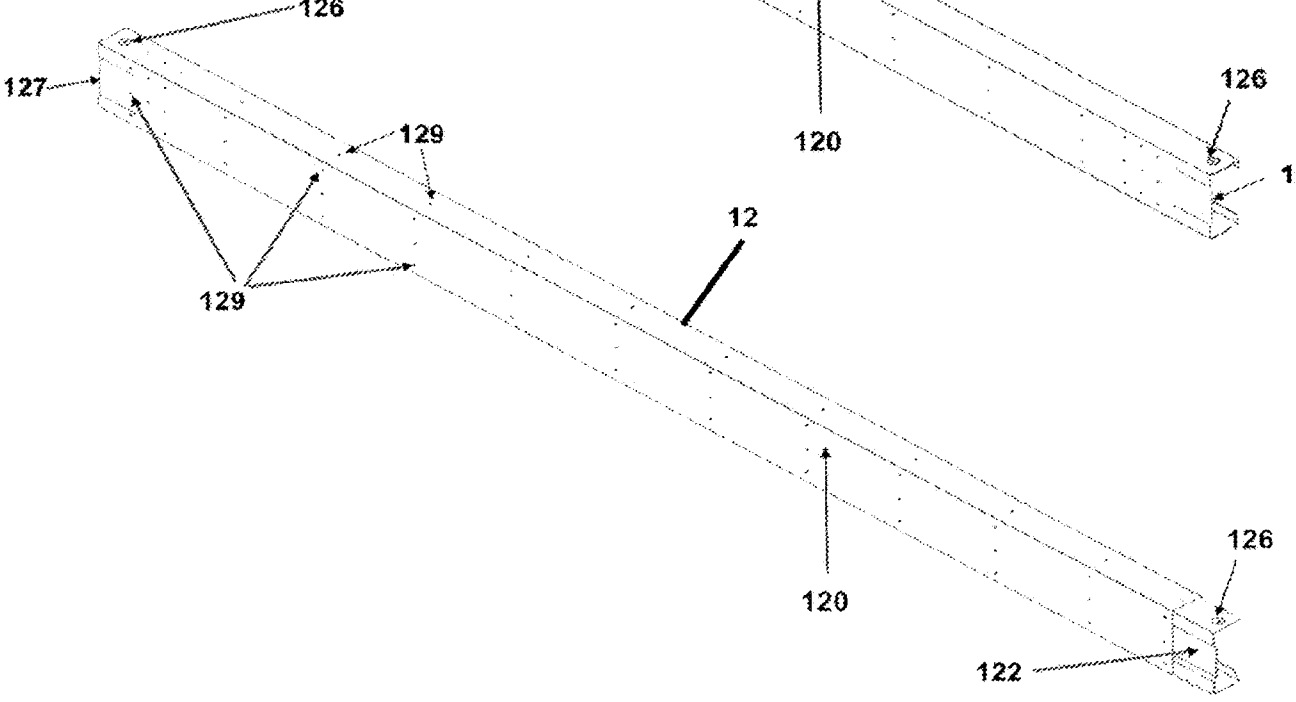
FIG. 4 is a perspective view of the bottom face of the extendable joist and its components when assembled.
Figure 5:
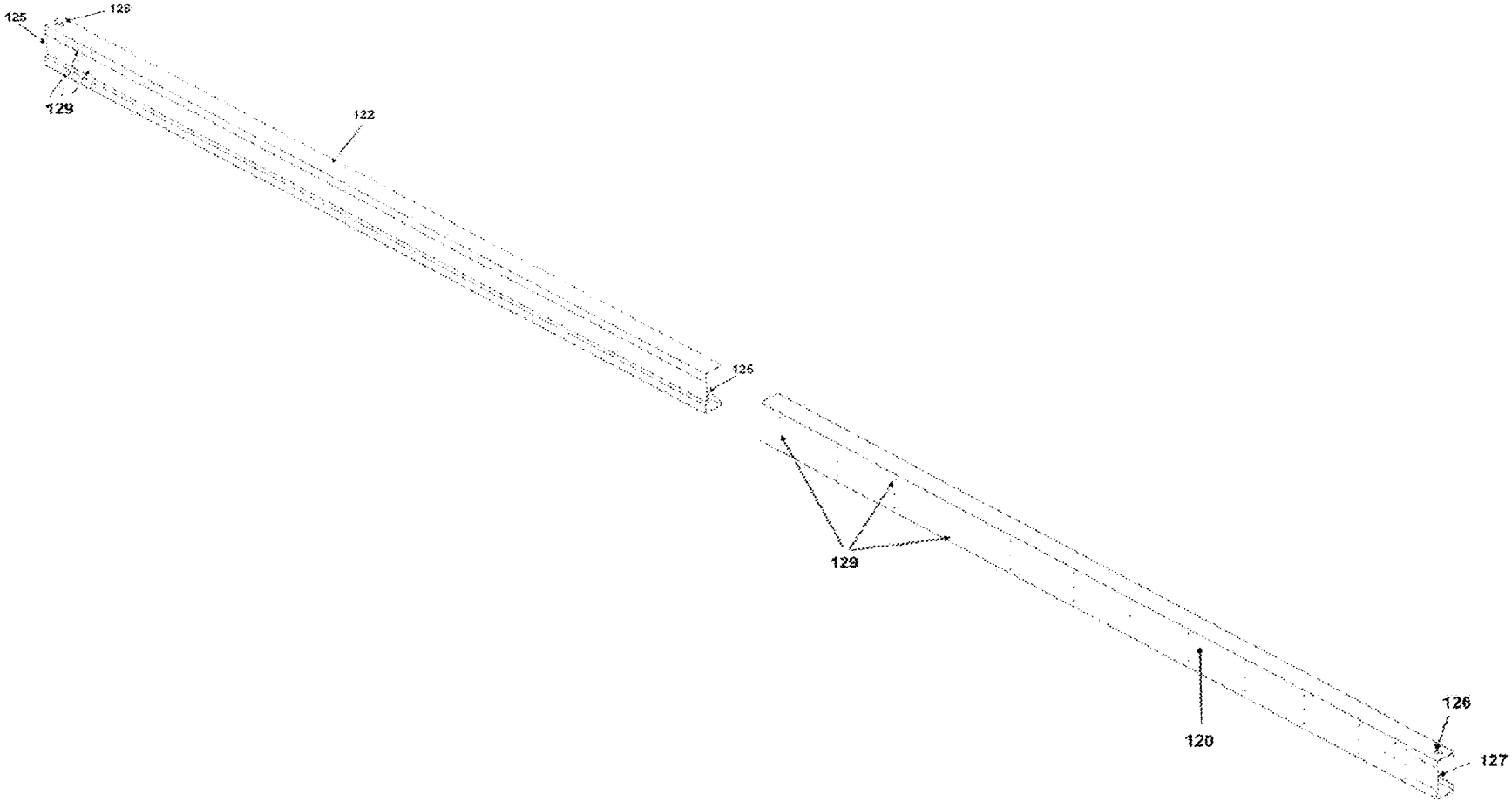
FIG. 5 is an exploded view of the extendable joist of FIG. 3.
Figure 6:
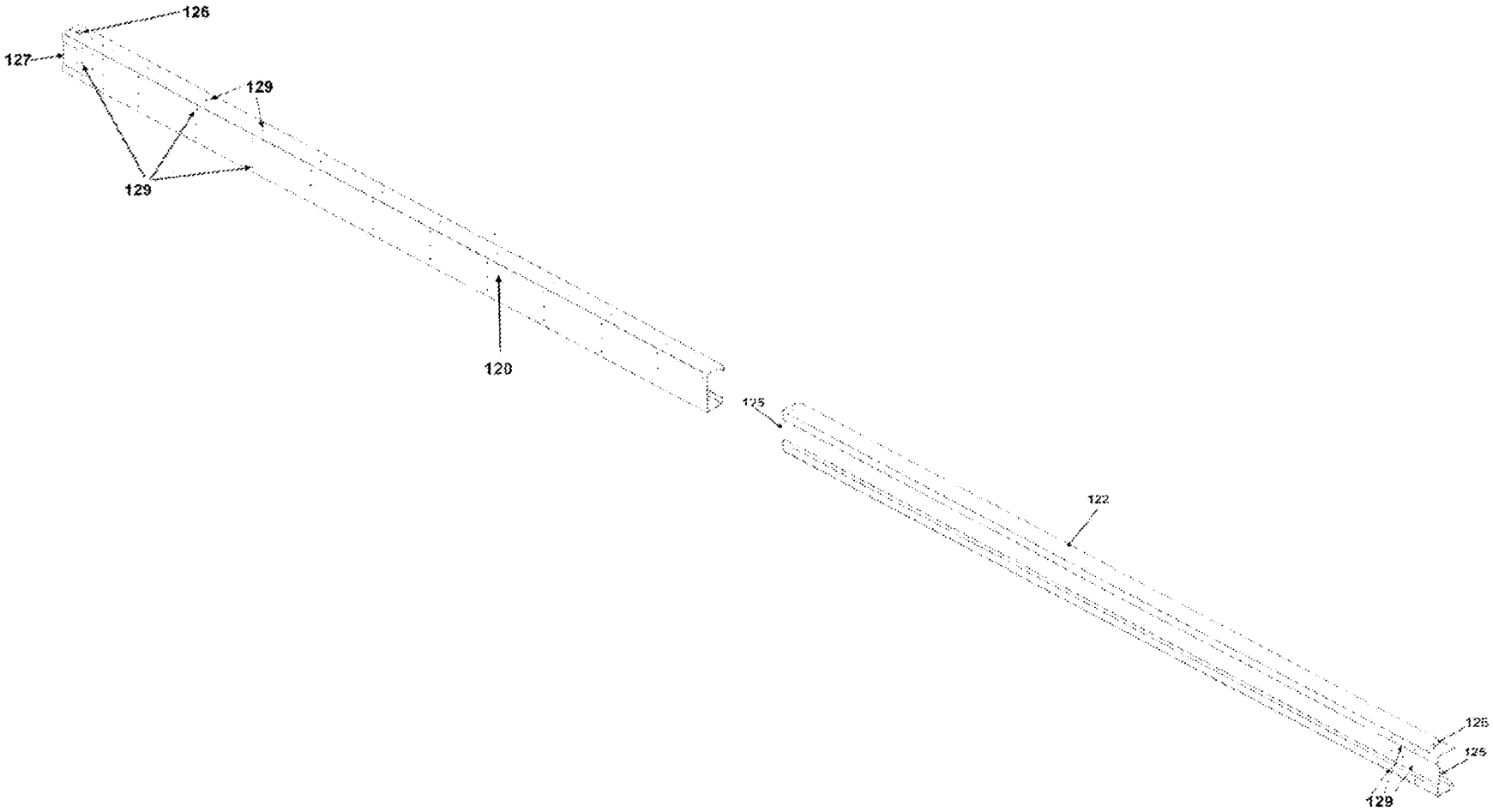
FIG. 6 is an exploded view of the extendable joist of FIG. 4.
Figure 7:
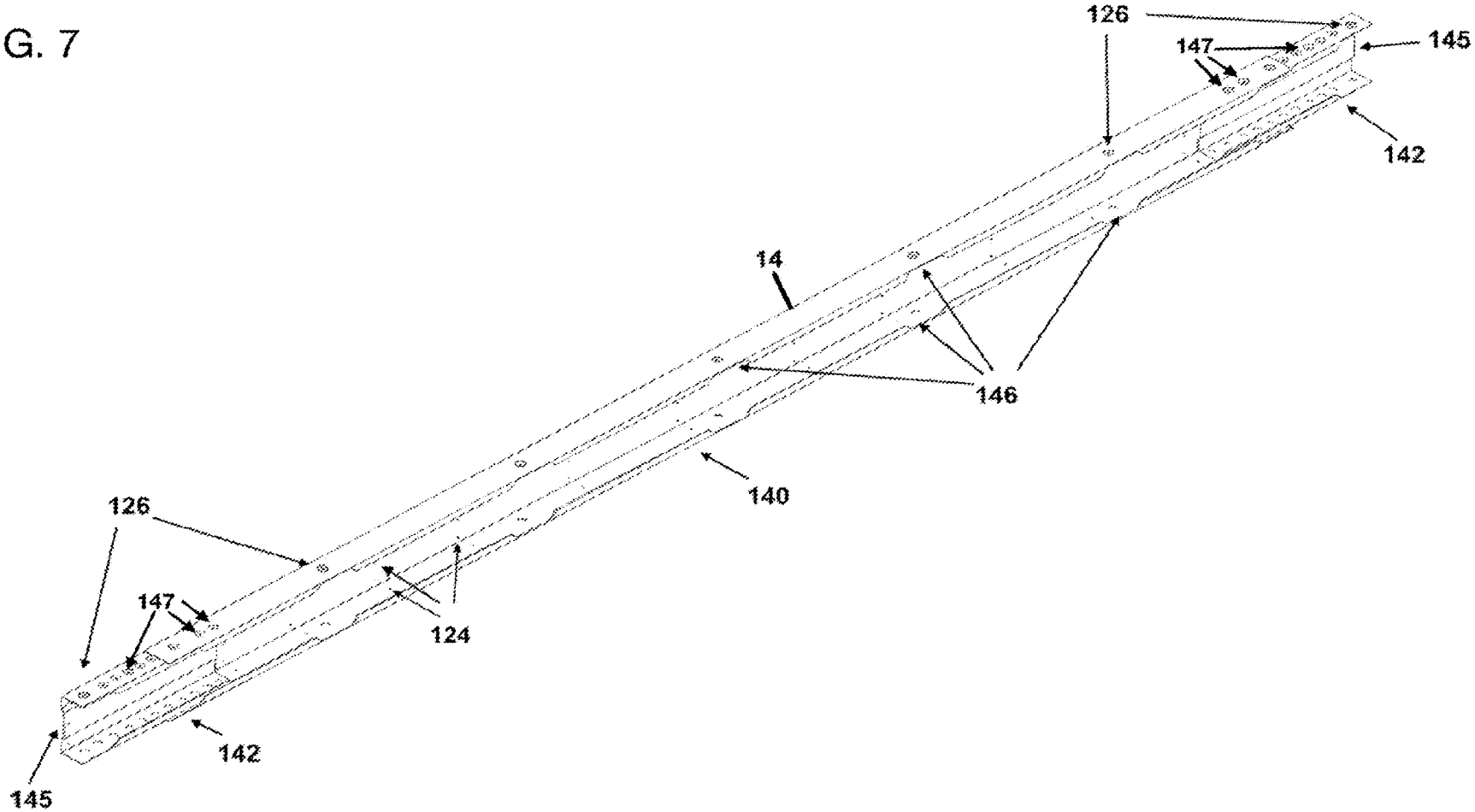
FIG. 7 is a perspective view of the extendable beam and its components when assembled.

Referring now generally to FIGS. 1-20, there is shown a pre-printed and assembled extendable modular decking system 10 constructed in accordance with the present disclosure. The modular decking system 10 includes a plurality of pre-printed and extendable decking joists 12 which are connected to preprinted extendable beams 14, which are carried by pre-printed and extendable bearer members 16 which are in turn supported by pre-printed and extendable, "extender", or "extenda" posts 18. The extendable posts 18 serve to support the bearer members 16 at a suitable distance above ground level. Each of the major components of the decking system 10 (namely the extendable decking joists 12, the extendable beams 14, the extendable bearers 16, and the extendable posts 18) are printed using light gauge steel from a custom machine to specific sizes, with holes punched for fixing, which can be recessed so fixings sit flush where necessary. Due to the size of the components printed and the extendable functionality, multiple modules of the decking system 10 may be fixed together to form a deck of infinite size without the need for any components to be cut or drilled.

The major components of the decking system 10 will now be described in further detail before turning to a description of the manner of the interaction of those components. The components of the decking system may comprise any desired material, such as light gauge steel, galvanized or ungalvanized, or aluminum. Other components may be added or removed as appreciated by those skilled in the art.

The extendable joist 12 is made up of two components, a first joist member 120 and a second joist member 122 disposed within and movable relative to the first joist member 120 (FIGS. 3-6). In other words, the joist 12 comprises the joist 120 and the joist "extenda" 122. The joist extenda 122 can slide in and out within the joist 120 to allow multiple lengths to be achieved without having to cut or drill anything. The joist extenda 122 is pre-punched with multiple fixing holes 129 and recessed with a channel 125 to allow the extendable joist 12 to be set in multiple indexed positions and be easily located within a beam 14 when assembled.

The joist extenda 122 has a back wall which defines its longitudinal axis, a pair of outwardly extending horizontal walls which are substantially perpendicular to the back wall, and a pair of inwardly extending lips which are substantially perpendicular to the horizontal walls. The back wall has the recessed channel 125 in its rear or first-joist-facing surface, which thereby decreases the contacting surface area for reducing friction between the joist extenda 122 and the joist 120. The joist extenda 122 consists of a modified C shape with the longest face being the main vertical face of the C profile containing the channel 125, two horizontal faces which are from 25% to 50% of the size of the main vertical face, and then two additional vertical "lips" which are between 20% and 40% of the size of each horizontal face. The joist extenda 122 fits inside of the joist 120 to slide in and out creating the tailorable length functionality, though it is conceivable that it could sit outside of the joist 120. For example, the extendable joist 12 may be set to a length that suits in approximately 12.5 mm (½ inch) increments, plus or minus 10 mm. It is conceivable that the joist 12 may have two joist extendas 122 so that the joist 12 may extend in two directions.

The joist 120 is pre-punched with multiple recessed fixing holes 129 and 126 to both guide the location of the screw fixings 128 during installation, via for example fixing holes 129, and to allow the fixings to sit flush below the surface of the joist 120, via for example fixing holes 126. This allows additional modular decking system modules 10 to be attached to each other without inhibiting functionality.

The joist 120 has a back wall which defines its longitudinal axis, a pair of outwardly extending horizontal walls which are substantially perpendicular to the back wall, and a pair of inwardly extending lips which are substantially perpendicular to the horizontal walls. The joist 120 defines an opening in which the joist extenda 122 is received. The contact points between the joist 120 and the joist extenda 122 are defined by the lips and the two rail-like surfaces on either side of the rear channel 125 of the joist extenda 122. The joist 120 consists of a modified C shape with the longest face being the main vertical face of the C profile containing the pressed channel 127 at one end (the end that joins Beam 14 without the addition of the extenda 122). It consists of a further two horizontal faces which are from 25% to 50% of the size of the main vertical face, and then two additional vertical "lips" that are between 20% and 40% of the size of each horizontal face. The pressed channel 127 extends from the end of the joist 120 into the joist up to 10% of the total length of the joist. At the opposite end the joist 120 consists of a C shape with the longest face being the main vertical face of the C profile, two horizontal faces which are from 25% to 50% of the size of the main vertical face, and then two additional vertical "lips" which are between 20% and 40% of the size of each horizontal face. It is conceivable that the C profile could be square.

When the desired length of the extendable joist 12 is determined, the joist extenda 122 is positioned within the joist 120 and is connected to the extendable beam 14 using the recessed punched holes 126 in both the extendable joist 12 and the extendable beam 14 as a guide. All extendable joists 12 within each modular decking system 10 will be connected to the extendable beam 14 before being set to length with one or more fasteners using the prepunched holes 126 in the joist 120. It is conceivable that the components could be fixed together using locations other than those that have been prepunched. The fixings or fasteners 128 may comprise any desired fasteners, such as screws 128.

Figure 8:
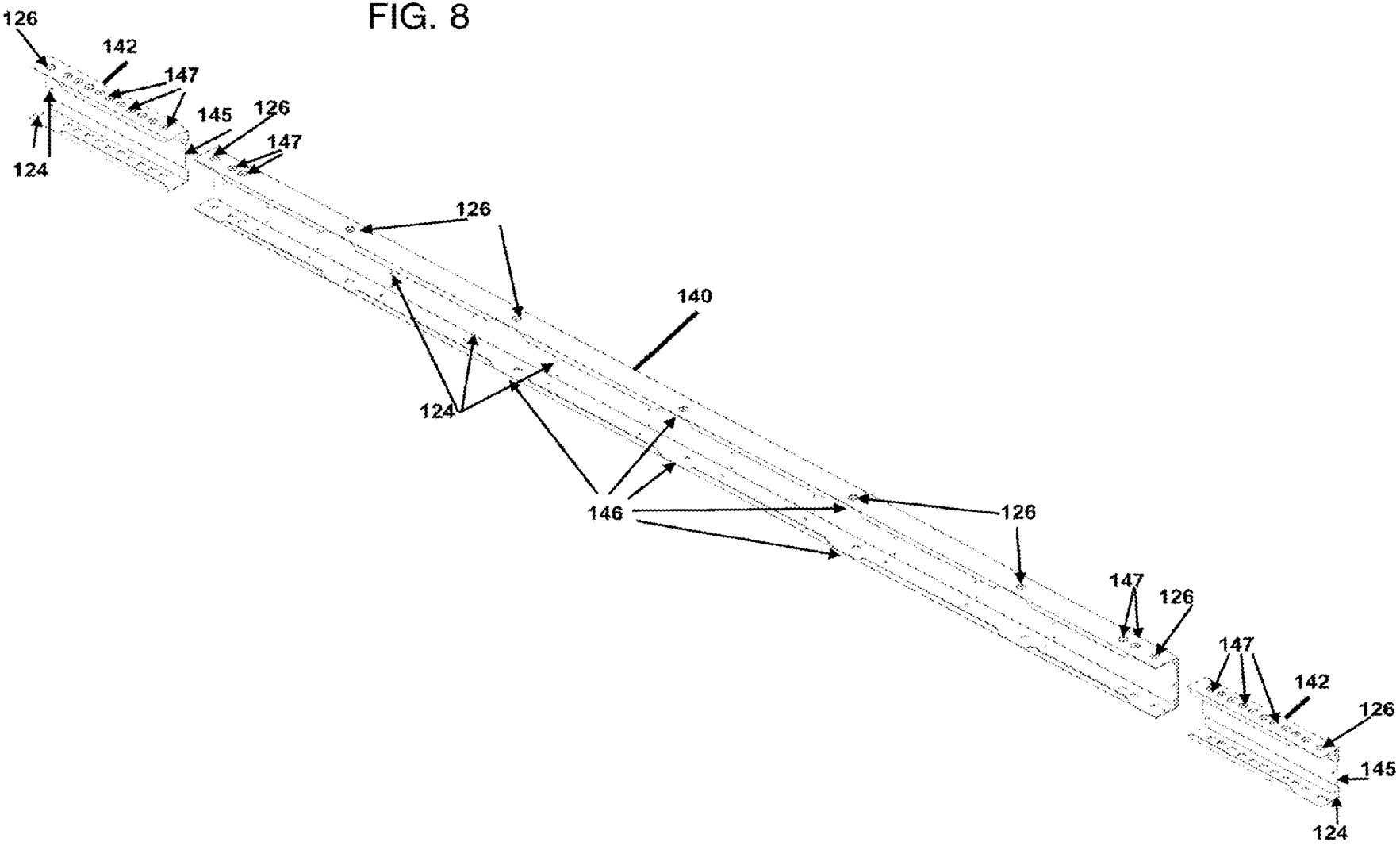
FIG. 8 is an exploded view of the extendable beam of FIG. 7.
Figure 9:
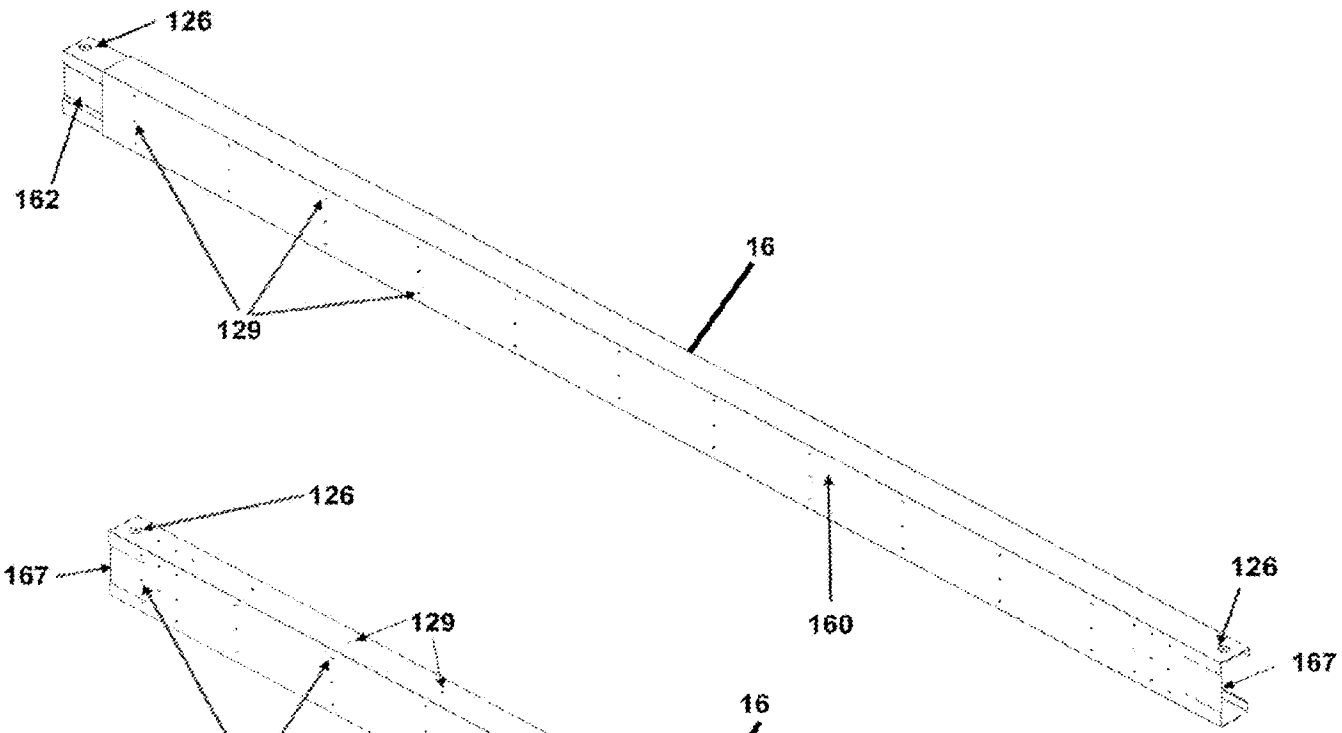
FIG. 9 is a perspective view of the top face of the extendable bearer and its components when assembled.
Figure 10:
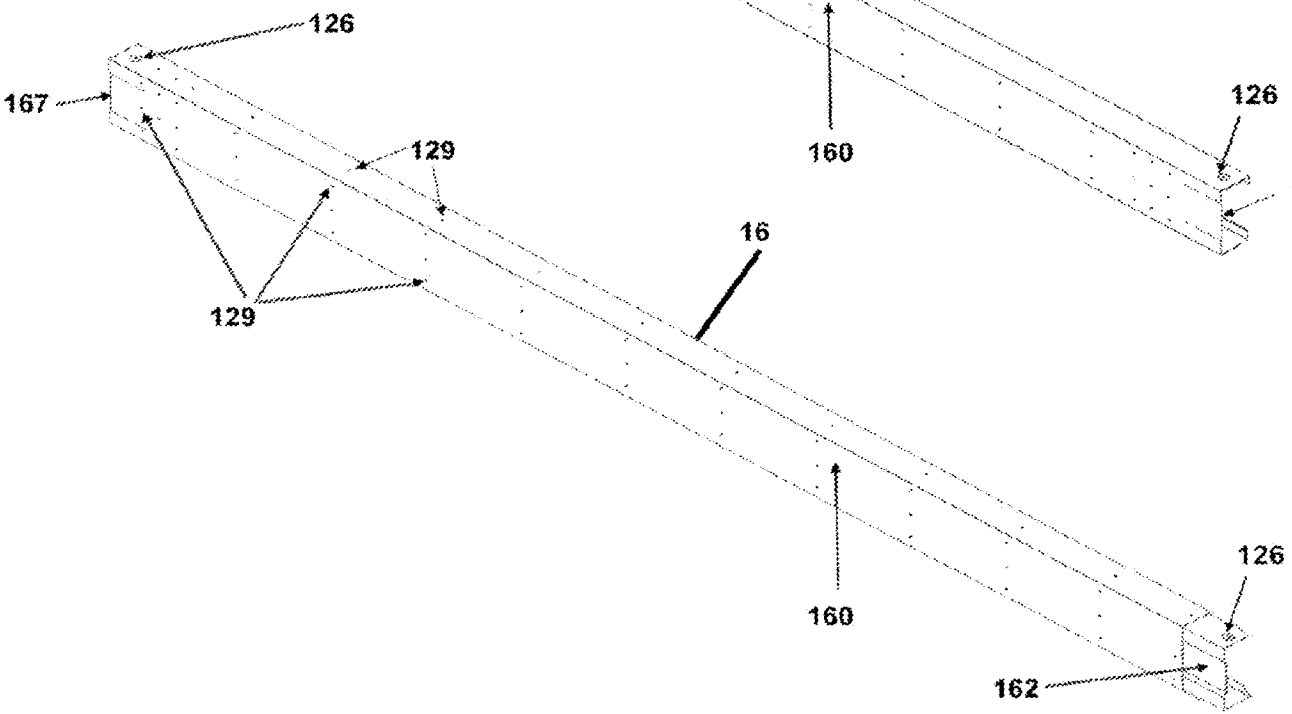
FIG. 10 is a perspective view of the bottom face of the extendable bearer and its components when assembled.
Figure 11:
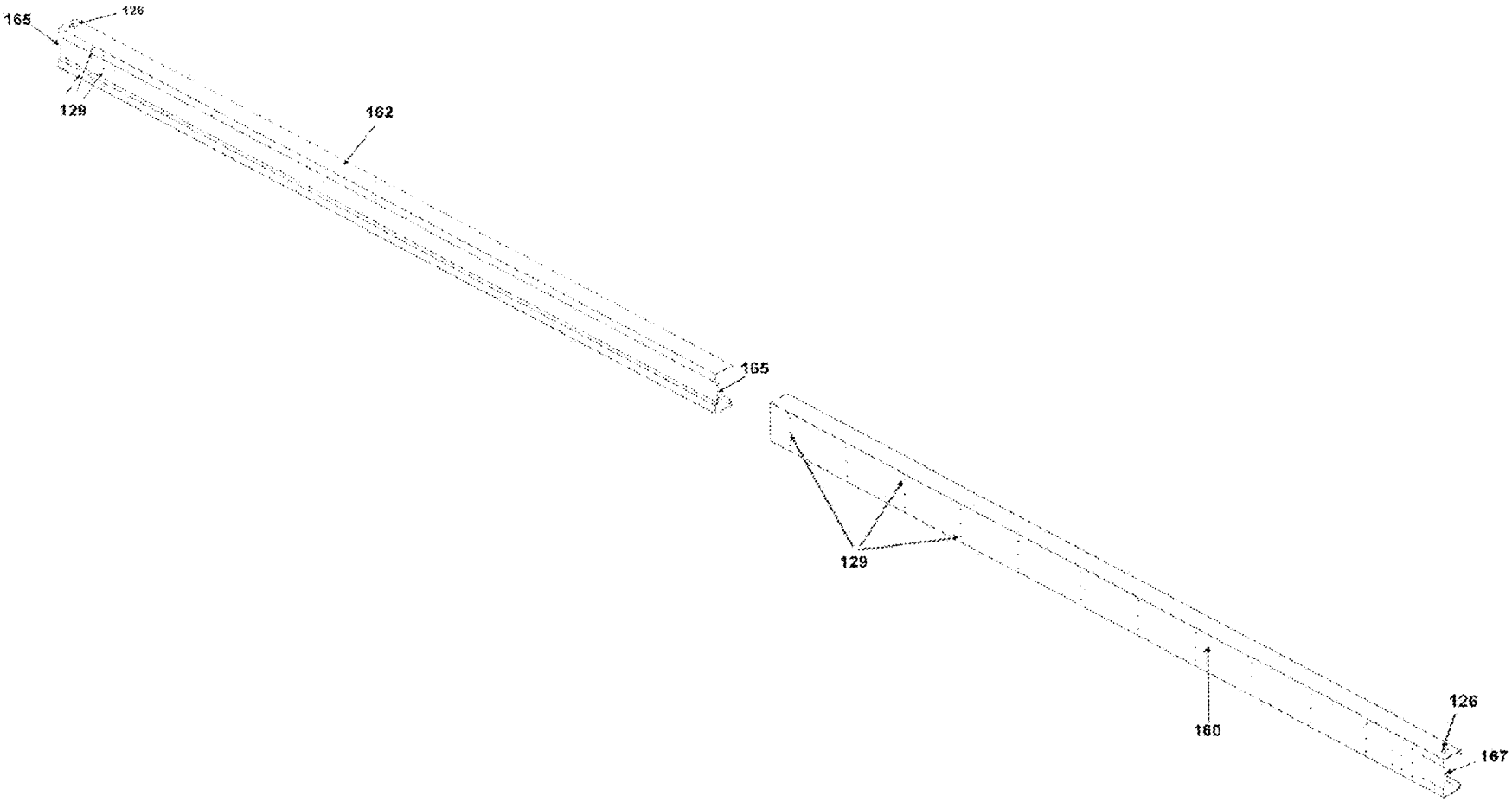
FIG. 11 is an exploded view of the extendable bearer of FIG. 9.
Figure 12:
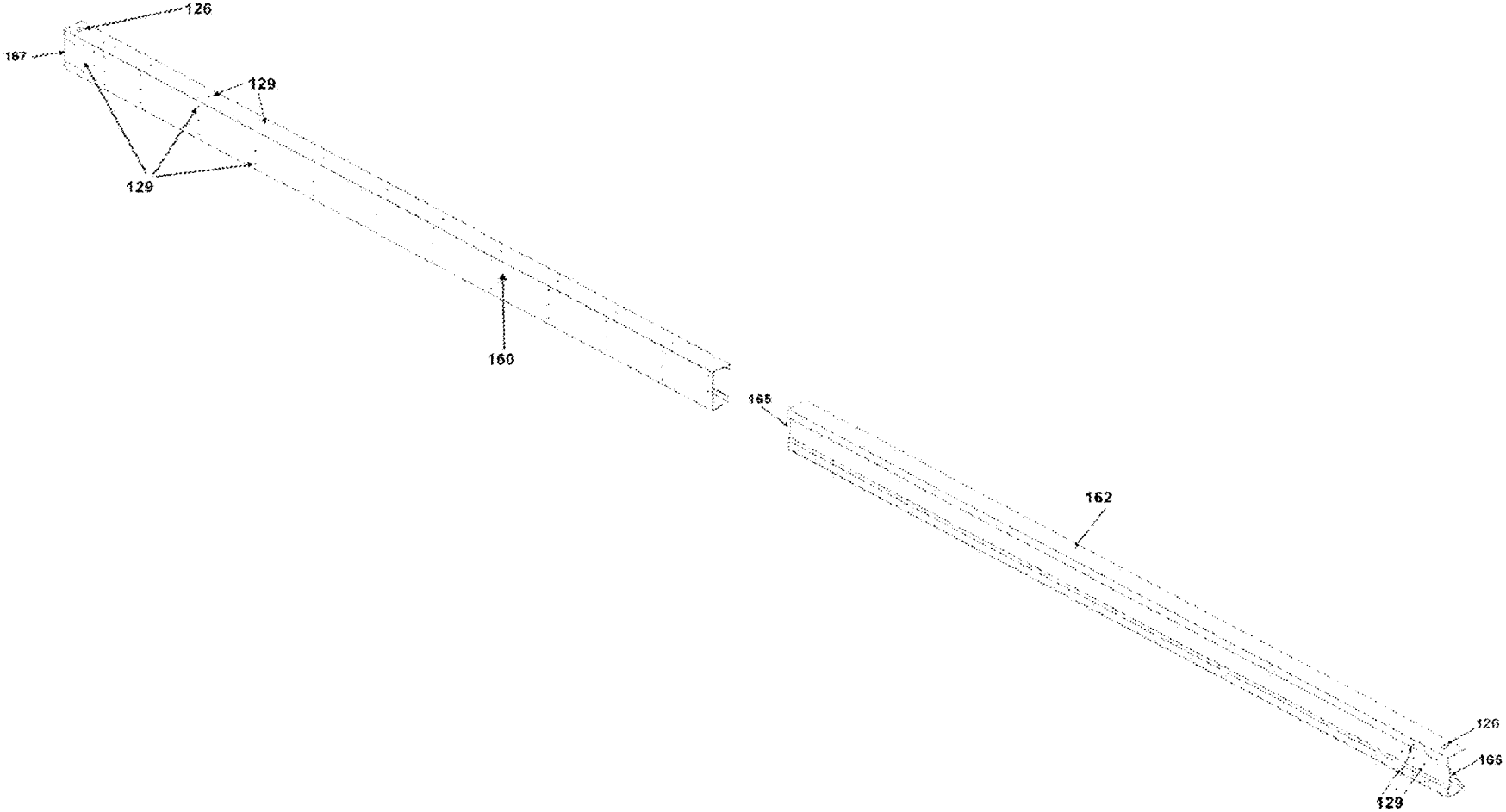
FIG. 12 is an exploded view of the extendable bearer of FIG. 10.
Figure 14:
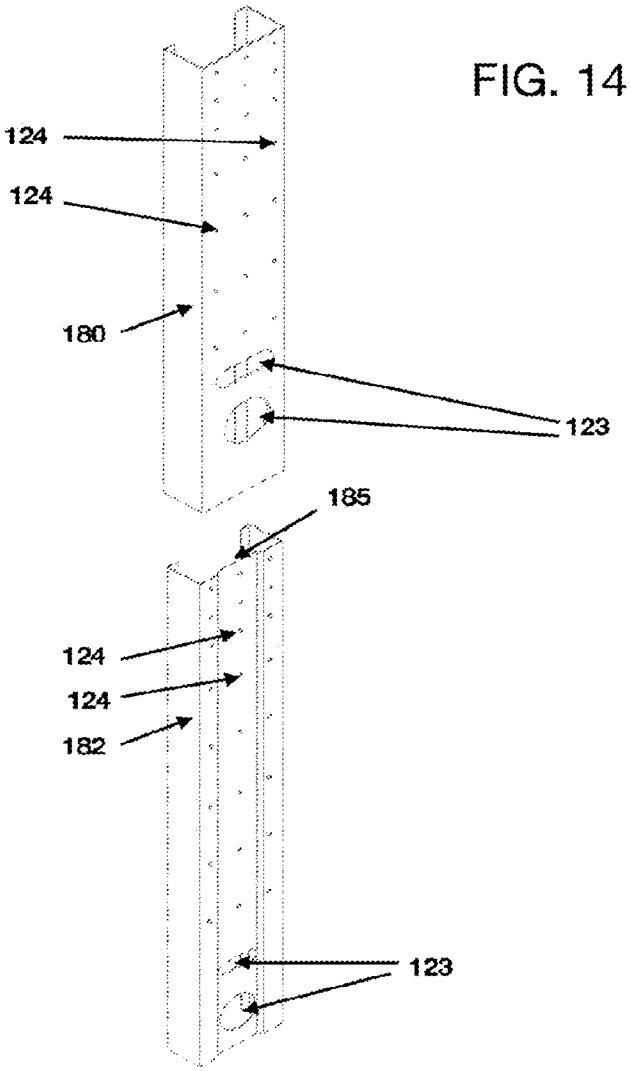
FIG. 14 is an exploded view of the extendable post of FIG. 13.
Figure 13:
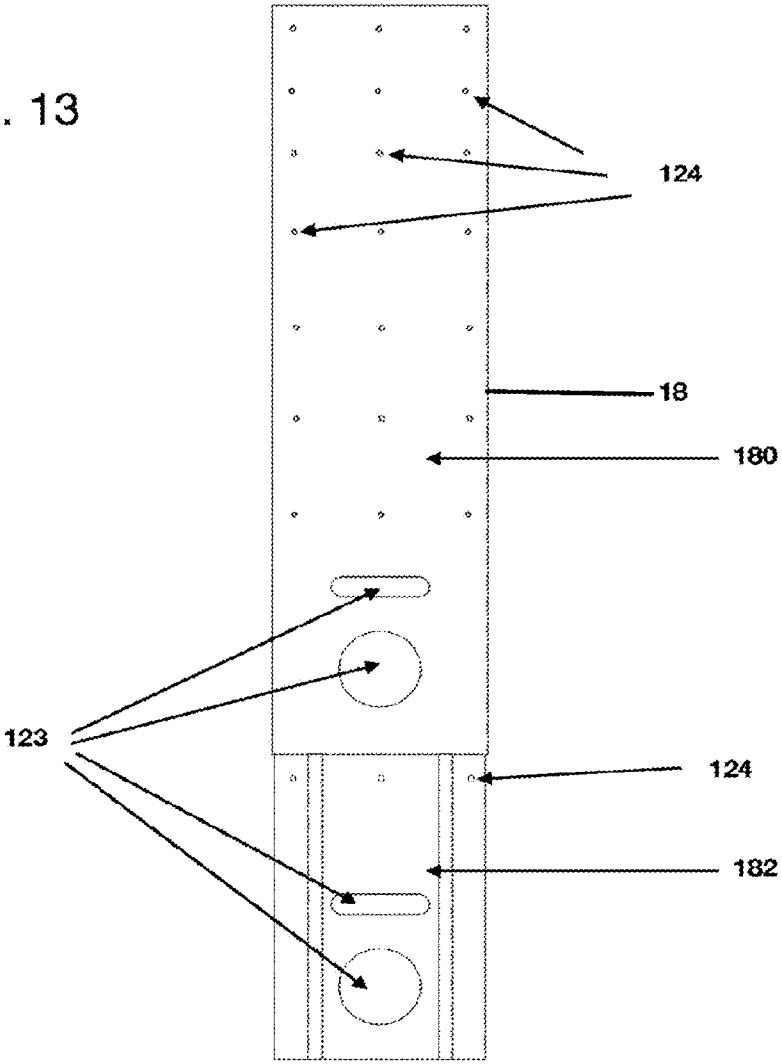
FIG. 13 is an elevation view of the extendable post and its components assembled.
Figure 15:
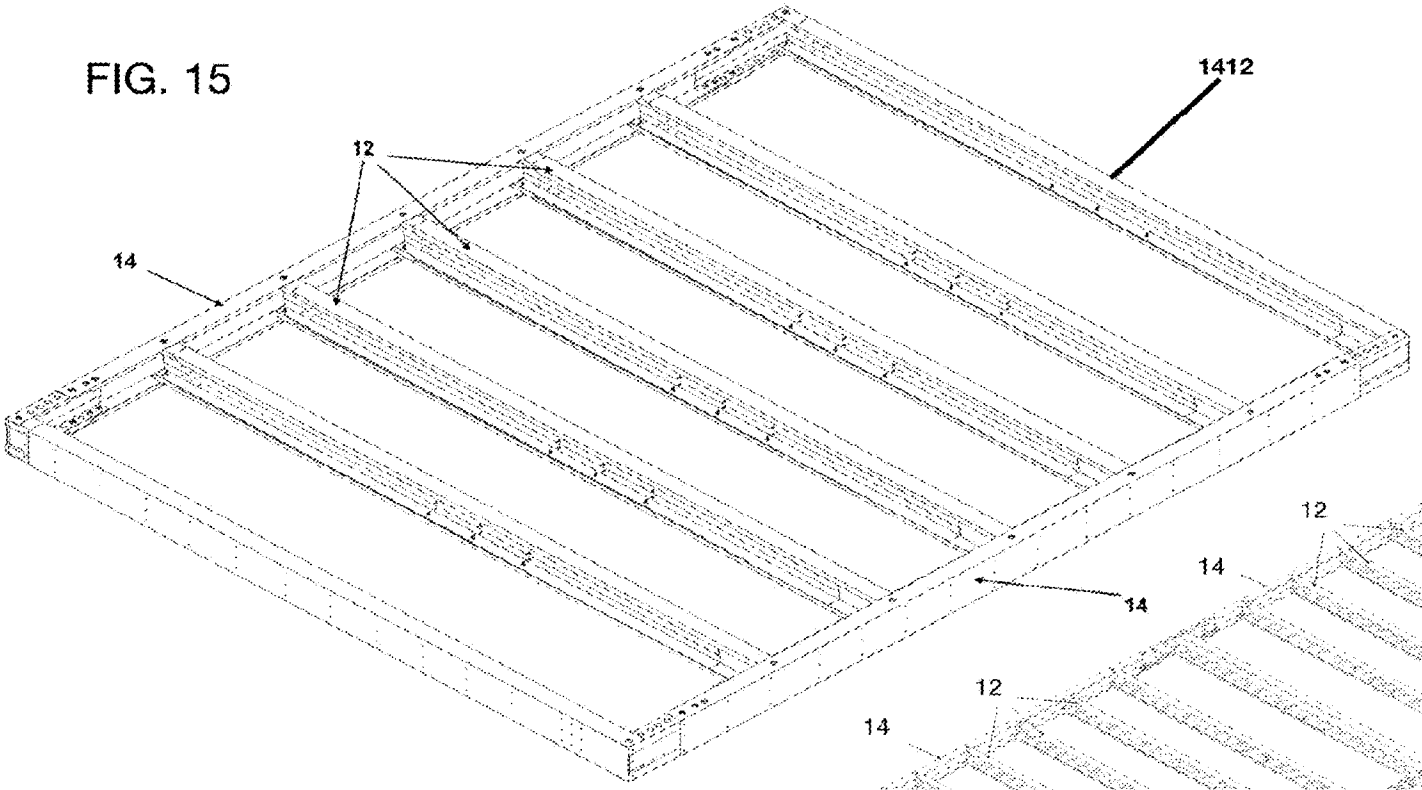
FIG. 15 is a perspective view of the assembled components of FIG. 3 and FIG. 7 to make up the assembled modular decking module.
Figure 16:
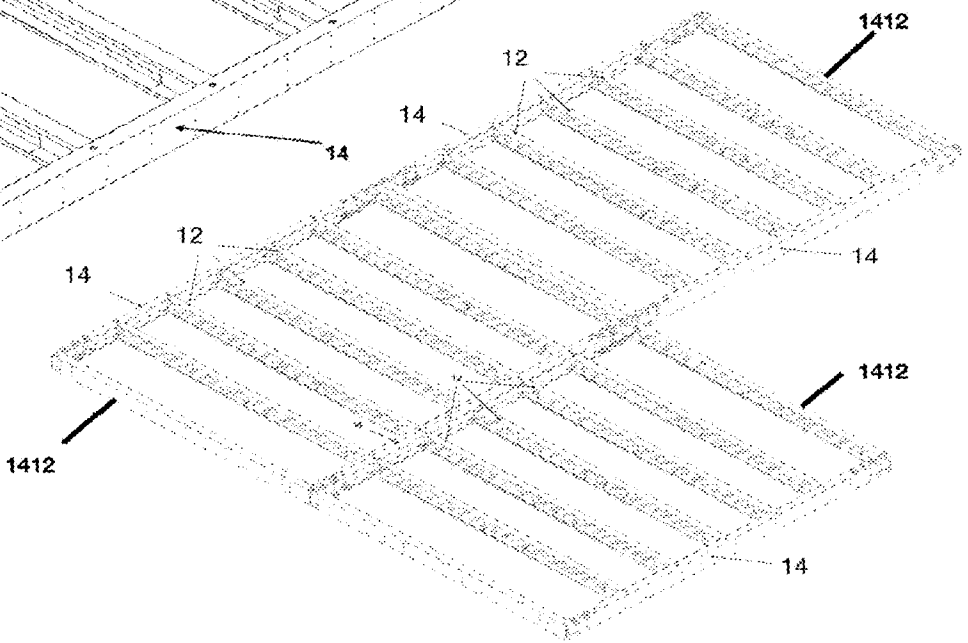
FIG. 16 is a perspective view of multiples of FIG. 15 connected together.
Figure 17:
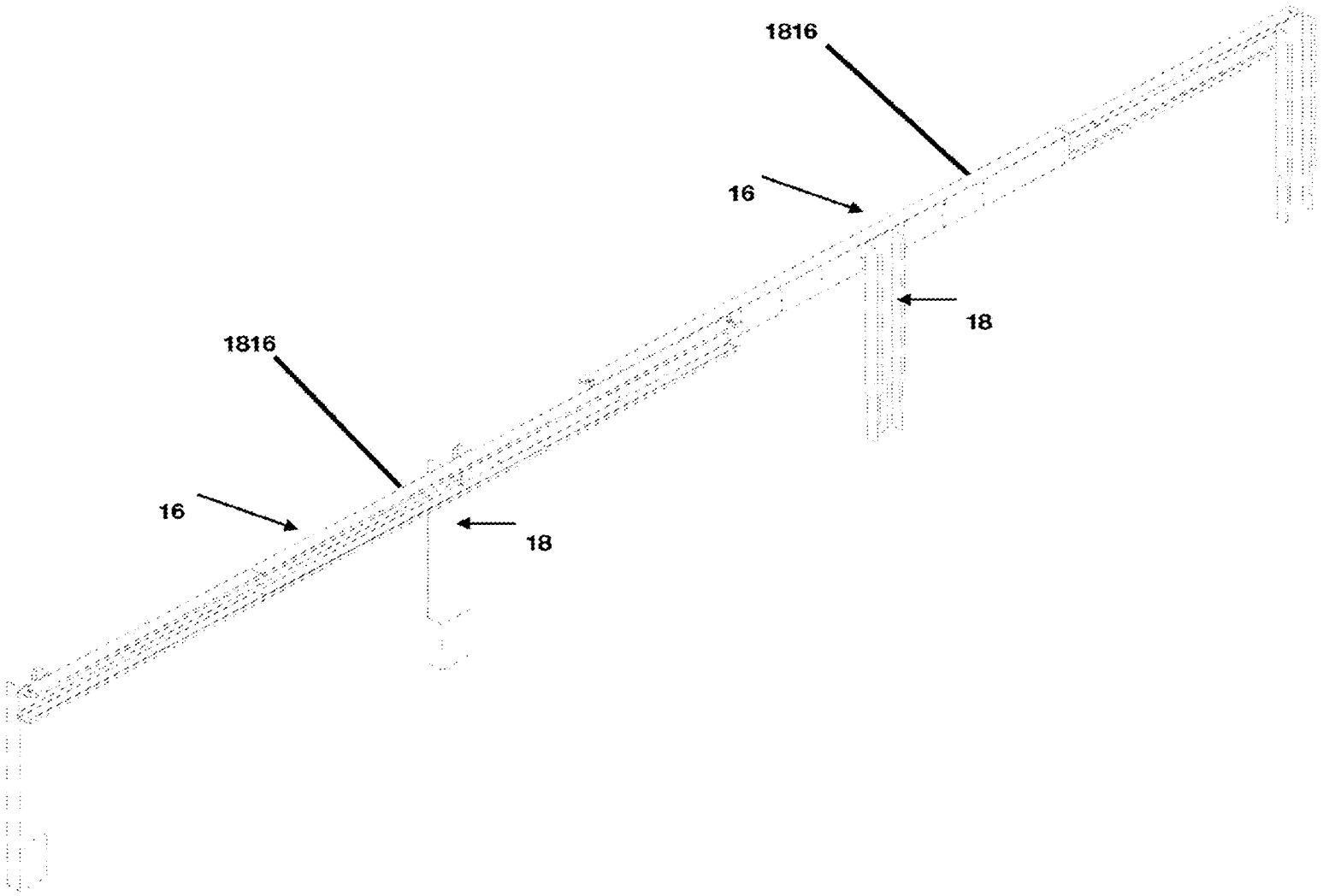
FIG. 17 is a perspective view of multiples of FIG. 9 and FIG. 13 connected together.
Figure 20:
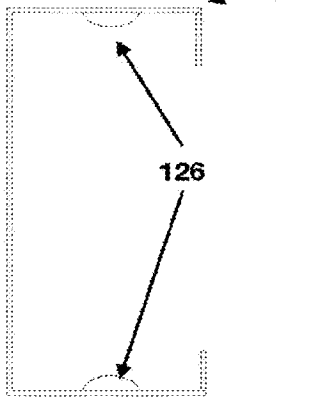
FIG. 20 is an elevation view of a C shape.
Figure 19:
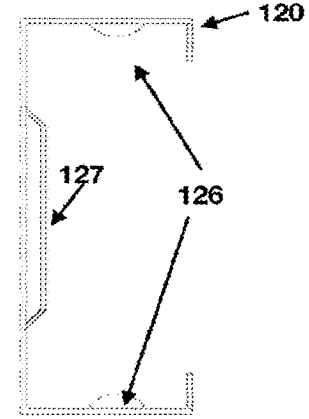
FIG. 19 is an elevation view of a modified C shape containing a pressed channel.
Figure 18:
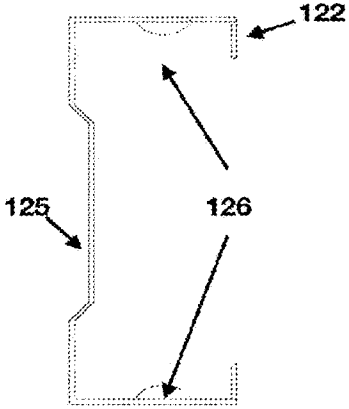
FIG. 18 is an elevation view of a modified C shape.

The extendable beam 14 is made up of three components, which are shown separated relative to one another in FIG. 8. The extendable beam 14 includes a first beam member 140 and second beam members 142 disposed within and movable relative to the first beam member 140, and each beam member 142 is located at each end of the first beam member 140. In other words, the extendable beam 14 comprises a beam 140 and two beam "extendas" 142, allowing either end to be extended. It is conceivable that the beam 14 may comprise a beam 140 and only one beam extenda 142 or a beam only. The beam 14 may be set to any desired length that suits. For example, the beam 14 may be set in approximately 25 mm (1 inch) increments, plus or minus 10 mm.

The beam extenda 142 can slide in and out within the beam 140 to allow multiple lengths to be achieved, without having to cut anything. The beam extenda 142 is prepunched with multiple fixing holes 147 and recessed with a channel 145 in its rear or first-beam-member-facing surface to allow the extendable beam 14 to be set in multiple indexed positions. The fixing holes 147 are located on the top and bottom horizontal faces of the beam extenda 142.

The beam extenda 142 has a back wall which defines its longitudinal axis, a pair of outwardly extending horizontal walls which are substantially perpendicular to the back wall, and inwardly extending lips which are substantially perpendicular to the horizontal walls. The back wall has the recessed channel 145 in its rear or first-beam-member-facing surface, which thereby decreases the contacting surface area for reducing friction between the beam extenda 142 and the beam 140. The lips may have locating members, e.g., cutouts in the lips. For example, the lips may have cutouts at their distal ends such that the lips do not extend to the distal end of each beam extenda 142. The beam extenda 142 consists of a modified C shape with the longest face being the main vertical face of the C profile containing the channel 145, two horizontal faces which are from 25% to 50% of the size of the main vertical face, and then two additional vertical lips which are between 20% and 40% of the size of each horizontal face. The beam extenda 142 fits inside of the beam 140 to slide in and out creating the tailorable length functionality, though it is conceivable that it could sit outside of the beam 140.

The beam 14 has recessed fixing holes 126 to connect to the joists 12. The beam 140 is pre-punched with multiple recessed fixing holes 126 to allow the fixings to sit flush below the surface of the beam 140. This allows decking planks to be fixed down appropriately.

The beam 14 also has multiple pre-punched fixing holes 124 to allow additional modular decking modules 10 to be attached to each other without inhibiting functionality.

The beam 140 has a back wall which defines its longitudinal axis, a pair of outwardly extending horizontal walls which are substantially perpendicular to the back wall, and a pair of inwardly extending lips which are substantially perpendicular to the horizontal walls. The beam 140 defines an opening in which the beam extenda 142 is received. The contact points between the beam 140 and the beam extenda 142 are defined by the lips and the two rail-like surfaces on other side of the rear channel 145 of the beam extenda 142. The beam 140 consists of a C shape with the longest face being the main vertical face of the C profile, two horizontal faces which are from 25% to 50% of the size of the main vertical face, and then two additional vertical lips which are between 20% and 40% of the size of each horizontal face.

At each location where a joist 12 attaches to the beam 14, there is a locating member 146 within the lip of the beam 14. For example, the locating member 146 can be in the form of a locator cutout 146 in the light gauge steel of the beam 14 to aid the locating of the joist 12 and a recessed fixing hole 126 in the beam 14 to match that on the joist 12 to ensure the two pieces clip together. Thereby, a fixing will sit flush, and no drilling is required. The locating members are cut from the lip at a size of 100% to 200% of the width of the two horizontal faces of the beam 140 and beam extenda 142.

The extendable bearers 16 are configured for supporting the weight of the joist members 12 and the beams 14. The extendable bearer 16 is made up of two components shown separated relative to one another in FIG. 11 and FIG. 12. The extendable bearer 16 includes a first bearer member 160 and a second bearer member 162 disposed within and movable relative to the first bearer member 160. In other words, the extendable bearer 16 comprises a bearer 160 and a bearer "extenda" 162.

The bearer extenda 162 can slide in and out within the bearer 160 to allow multiple lengths to be achieved without having to cut or drill anything. The bearer extenda 162 is pre-punched with multiple fixing holes 129 and recessed with a channel 165 in its rear or first-bearer-member-facing surface to allow the extendable bearer 16 to be set in multiple indexed positions. The extendable bearer 16 can be set to any length that suits. For example, the extendable bearer 16 may be set to a length that suits in approximately 12.5 mm (½ inch) increments, plus or minus 10 mm.

The bearer extenda 162 has a back wall which defines its longitudinal axis, a pair of outwardly extending horizontal walls which are substantially perpendicular to the back wall, and inwardly extending lips which are substantially perpendicular to the horizontal walls. The top horizontal wall may not have a lip. The back wall has the recessed channel 165 in its rear or first-bearer-member-facing surface, which thereby decreases the contacting surface area for reducing friction between the bearer extenda 162 and the bearer 160. The bearer extenda 162 consists of a modified C shape with the longest face being the main vertical face of the C profile containing the channel 165, two horizontal faces which are from 25% to 50% of the size of the main vertical face, and then two additional vertical "lips" which are between 20% and 40% of the size of each horizontal face. The bearer extenda 162 fits inside of the bearer 160 to slide in and out creating the tailorable length functionality, though it is conceivable that it could sit outside of the bearer 160.

The bearer 160 is pre-punched with multiple fixing holes 129. This allows an extendable post 18 to be attached to the bearer 160 without inhibiting functionality. The bearer 160 has a back wall which defines its longitudinal axis, a pair of outwardly extending horizontal walls which are substantially perpendicular to the back wall, and a pair of inwardly extending lips which are substantially perpendicular to the horizontal walls. The bearer 160 defines an opening in which the bearer extenda 162 is received. The contact points between the bearer 160 and the bearer extenda 162 are defined by the lips and the two rail-like surfaces on other side of the rear channel 165 of the bearer extenda 162. The bearer 160 consists of a C shape with the longest face being the main vertical face of the C profile, two horizontal faces which are from 25% to 50% of the size of the main vertical face, and then two additional vertical "lips" which are between 20% and 40% of the size of each horizontal face. When the desired length of the extendable bearer 16 is determined, the bearer extenda 162 is positioned within the bearer 160 and fixed in place with one or more fasteners 128.

The extendable post 18 includes a first post member 180 and a second post member 182 disposed within and movable relative to the first post member 180. In other words, the extendable post 18 comprises a post 180 and a post extenda 182. The extendable post 18 can be set to any length that suits. For example, the extendable post 18 can be set to a length that suits in approximately 12.5 mm (½ inch) increments, plus or minus 10 mm.

The post extenda 182 can slide in and out within the post 180 to allow multiple lengths to be achieved without having to cut or drill anything. The post extenda 182 is pre-punched with multiple fixing holes 124 and recessed with a channel 185 in its rear or first-post-member-facing surface to allow the extendable post 18 to be set into multiple indexed positions. The fixing holes 124 are located at the bottom of the channel 185. The post extenda 182 is pre-punched with multiple installation holes 123 to allow for ease of installation when being placed in the ground.

The post extenda 182 has a back wall which defines its longitudinal axis and a pair of outwardly extending horizontal walls which are substantially perpendicular to the back wall. The post extenda 182 may or may not include inwardly extending lips which are substantially perpendicular to the horizontal walls. The back wall has the recessed channel 185 in its rear or first-bearer-member-facing surface, which thereby decreases the contacting surface area for reducing friction between the post extenda 182 and the post 180. The post extenda 182 consists of a modified C shape with the longest face being the main vertical face of the C profile containing the channel 185, two horizontal faces which are from 25% to 50% of the size of the main vertical face, and then two additional vertical lips which are between 20% and 40% of the size of each horizontal face. The post extenda 182 fits inside of the post 180 to slide in and out creating the tailorable length functionality when required, though it is conceivable that it could sit outside of the post 180 or not be required at all.

The post 180 is pre-punched with multiple fixing holes 124. The fixing holes 124 in the post 180 guide the fixings of the post 180 to the post extender 182, or to the bearer 16. It is conceivable that the post 180 could be connected to the bearer 16 without requiring the use of the post extender 182. The post 180 is also pre-punched with multiple installation holes 123 to allow for ease of installation when being placed in the ground.

The post 180 has a back wall which defines its longitudinal axis, a pair of outwardly extending horizontal walls which are substantially perpendicular to the back wall, and a pair of inwardly extending lips which are substantially perpendicular to the horizontal walls. The post 180 defines an opening in which the post extenda 182 is received. The contact points between the post 180 and the post extenda 182 are defined by the lips and the two rail-like surfaces on other side of the rear channel 185 of the post extenda 182. The post 180 is of a C shape with the longest face being the main vertical face of the C profile, two horizontal faces which are from 25% to 50% of the size of the main vertical face, and then two additional vertical "lips" which are between 20% and 40% of the size of each horizontal face. When the desired length of the extendable post 18 is determined, the post extenda 182 is positioned within the post 180 and fixed in place with one or more fasteners 128.

The first and second members 120, 140, 160, 180, 122, 142, 162, 182 may comprise any desired size. The joist 120 and the joist extenda 122 may comprise any desired size. For example, the joist 120 may be approximately 1150 mm (3 ft., 9 in.) or 1615 mm (5 ft., 4 in.), plus or minus 305 mm (1 ft.). For example, the joist extenda 122 may be approximately 997 mm (3 ft., 9 in.) or 1495 mm (4 ft., 11 in.), plus or minus 305 mm (1 ft.). Additionally, for example, the beam 140 may be approximately 1220 mm (4 ft.), 1524 mm (5 ft.), or 1830 mm (6 ft.), plus or minus 305 mm (1 ft.). The beam extenda 142 may be 250 mm (10 in.), plus or minus 125 mm (5 in.). The width of the first and second members 120, 140, 160, 180, 122, 142, 162, 182 may be approximately 90-150 mm (3.5 in.-6 in.), plus or minus 10 mm (½ in.). Thereby, the eight different components may be used to create six modules that in turn may build any size of deck.

To assemble the components into the assembled module 10, as shown in FIG. 1, each component 12, 14, 16 and 18 must first be assembled. When the plurality of extendable joists 12 and extendable beams 14 are assembled at the desired lengths, the extendable joists 12 are connected to the extendable beam 14 in each area of locator cut outs 146 by placing the recessed fixing hole 126 on each end of the extendable joist 12 inside one of the recessed fixing holes 126 on the extendable beam 14. The extendable joist 12 sits perpendicular to and inside the extendable beam 14, and is fixed with one or more fasteners 128, for example a single screw 128 at each recessed fixing hole 126. This should be completed for each modular decking system module 10.

When the extendable bearers 16 and extendable posts 18 have been assembled at the desired lengths, the extendable posts 18 may be attached to the extendable bearers 16 using the appropriate multiple fixing holes 124. The extendable posts 18 (which are now connected to the extendable bearers 16) should now be placed into pre-dug holes of sufficient depth, and each modular decking system module 10 should be placed on the extendable bearers 16 and fixed appropriately to one another.

Where multiple modular decking system modules 10 are being used, these should be fixed to one another using the pre-punched multiple fixing holes 124, as well as to the corresponding extendable bearers beneath using appropriate fixings.

When the entire modular decking system 10 is in place, it can be set to the appropriate height using temporary blocking at regular intervals, before pouring concrete into the pre-dug holes to set the deck in place.

It is noted that the second, sliding members 122, 142, 162, 182 may be held in place within the first members 120, 140, 160, 180 due to static friction. In other words, the second members 122, 142, 162, 182 may be designed so that they have a tight tolerance with their corresponding first members 120, 140, 160, 180 so that they may slide with some effort from a user but be relatively fixed in place due to static friction.

In alternative embodiment, the modular decking system 10 may include locking members to lock the second, sliding members 122, 142, 162, 182 relative to the first members 120, 140, 160, 180. For example, each first member 120, 140, 160, 180 may comprise a first locking member that engages with a second locking member of the second members 122, 142, 162, 182. The first and second locking members may engage with one another to prevent the second members 122, 142, 162, 182 from sliding out of the first members 120, 140, 160, 180. The first and second locking members may be in the form of detents and indents, a detent and cutout, a cable, and/or a tongue and groove. It is also conceivable that the first and second locking members may temporarily lock the second members 122, 142, 162, 182 in indexed positions so that the user may easily fasten the second members 122, 142, 162, 182 to the first member 120, 140, 160, 180.

In another alternative embodiment, the modular decking system 10 may have a shipping position for temporarily storing the second members 122, 142, 162, 182 within the first members 120, 140, 160, 180. The first and second members 120, 140, 160, 180, 122, 142, 162, 182 may have respective holding members for temporarily holding the second members 122, 142, 162, 182 within the first members 120, 140, 160, 180 during storage and/or shipping. The holding members may comprise protrusions, e.g., detents, and indents. For example, each first member 120, 140, 160, 180 may have a detent on its upper rail portion or lip. Therein, each second member 122, 142, 162, 182 may have a corresponding indent on its upper rail portion or lip. The holding members may hold the second members 122, 142, 162, 182 within the first members 120, 140, 160, 180 such that the first members 122, 142, 162, 182 protrude out slightly in order for the user to easily grip them and extend them to a desired position.

In another alternative embodiment, the second members 122, 142, 162, 182 may fit over the first members 120, 140, 160, 180 instead of within the first members 120, 140, 160, 180. The first members 120, 140, 160, 180 may have a first width and a second width wherein the second width is smaller than the first width. The second width of the first members 120, 140, 160, 180 may also correspond to the size of the second members 122, 142, 162, 182, which thereby allows the second members 122, 142, 162, 182 to fit over the first members 120, 140, 160, 180.

Figure 21:
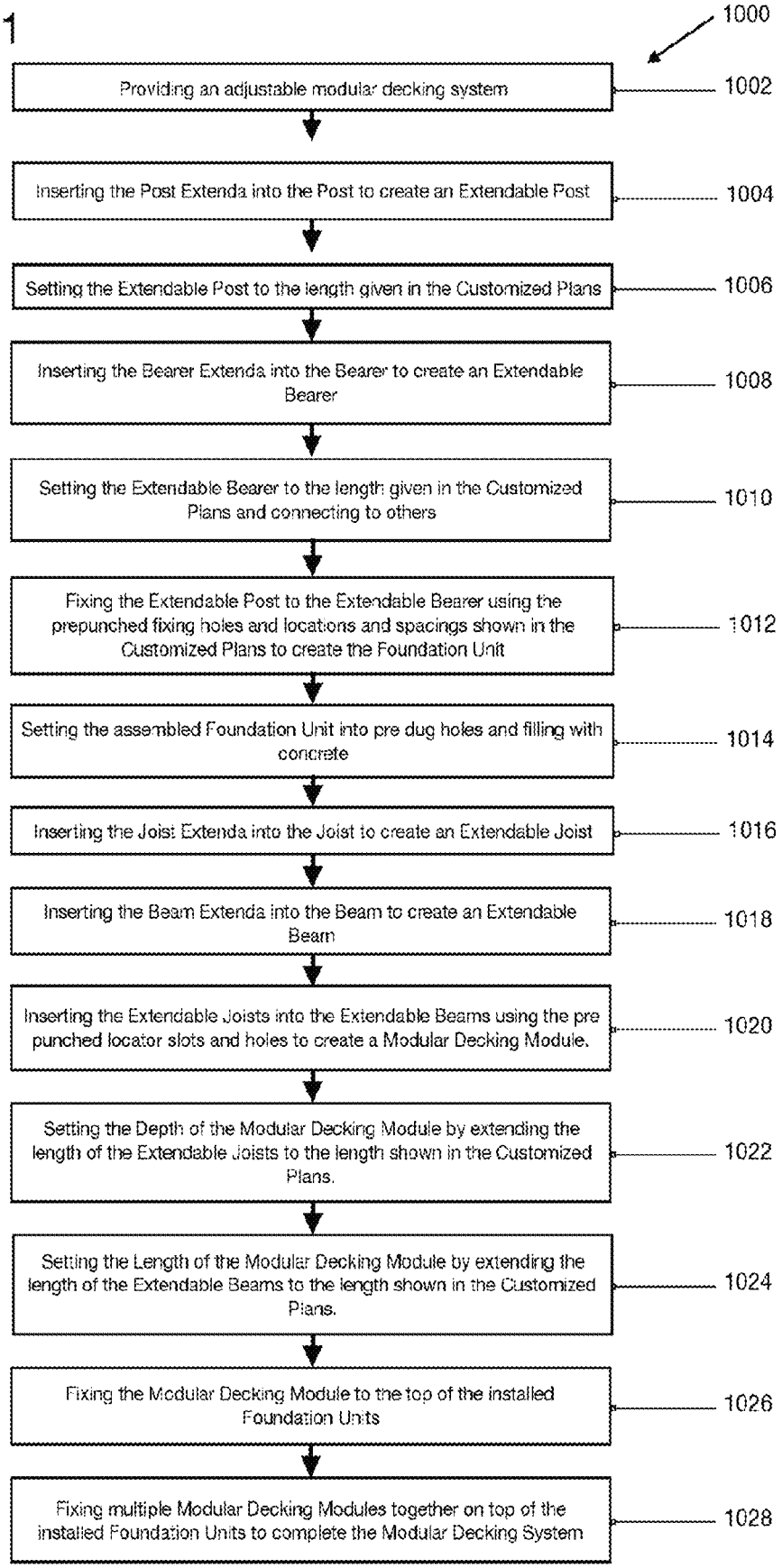
FIG. 21 is a flowchart of a method of assembling the modular decking system.

Referring now to FIG. 21, there is shown a flowchart of a method 1000 for assembling the various components of the modular decking system 10. The method 1000 may include an initial step of providing the modular decking system 10, as described above (at block 1002). The method 1000 may be performed by an end user or assembler, i.e., the individual installing the modular decking system 10. The assembler may assemble the modular decking system 10 according to any desired customized plan(s). The customized plan(s) may be provided to the assembler. The method 1000 may include assembling the post 18 (at block 1004). In more detail, the post 18 can be assembled by coupling, setting, and fixing the post extenda 182 to the post 180. The post extenda 182 can be inserted inside the post 180 to create the extendable post 18. The length of the extendable post 18 is then set and fixed with fasteners to a desired length in order to achieve a desired custom floorplan (at block 1006). The method 1000 may include assembling the bearer 16 (at block 1008). In more detail, the bearer 16 can be assembled by coupling, setting, and fixing the bearer extenda 162 to the bearer 160 to create the extendable bearer 16. The length of the extendable bearer 16 is then set and fixed with fasteners (1010). The method 1000 can then include creating a foundation unit by connecting the extendable bearer 16 to the post(s) 18 (at block 1012). At least one extendable post 18 can be fixed to the extendable bearer 16 by fastening into the prepunched holes 124 in the extendable post 18 to create the foundation unit. If desired, this foundation unit can now be placed into pre-dug holes and permanently concreted in place (1014). The method 1000 may then include at least partially assembling at least one joist 12 (at block 1016). The joist 12 is partially assembled by coupling the joist extenda 122 to the joist 120. Each joist extenda 122 is inserted into the joist 120 to create the extendable joist 12. The method 1000 may then include partially assembling the extendable beam 14 (at block 1018). The beam extendas 142 can be inserted into the beam 140 to create the extendable beam 14. The method 1000 may then include connecting the extendable joists 12 and the extendable beams (at block 1020). In more detail, the extendable joists 12 are inserted into the extendable beams 14 using the locating members 146 within the lip of the beam 14, and a recessed fixing hole 126 on the extendable beam 14, which correspondingly connects to a recessed fixing hole 126 on the joist 12. A fastener such as a screw completes the connection once the recessed fixing hole 126 of each extendable joist 12 is aligned with the recessed fixing hole 126 on the extendable beams 14. The method 1000 may then include setting the desired dimensions of the decking module 10 (at blocks 1022 and 1024). In more detail, the depth of the modular decking module 10 can be set by extending the length of the extendable joists 12 to the desired length by pulling one end of the module 10 away from the other end, allowing the joist extendas 122 to slide within the joists 120 (at block 1022). The length of each extendable joist 12 is then fixed with a fastener through prepunched fixing holes 129. Additionally, the length of the modular decking module 10 is set by extending the length of the extendable beams 14 to the desired length by pulling one end of the module 10 away from the other end, allowing the beam extenda 142 to slide within the beam 140 (at block 1024). The length of each extendable beam 14 is then fixed with a fastener through prepunched fixing holes 147. The extendable joists 12 and extendable beams 14, which are now set to their desired dimensions to define the dimensions of the module 10, define a deck unit. The method 1000 may then include connecting the deck unit to the foundation unit (at block 1026). The deck unit can be placed on and fixed to the installed foundation unit by connecting and fastening the extendable joists 12 onto the extendable bearers 16. In more detail, the bottom face of the extendable joists 12 can be placed onto the top face of the extendable bearers 16, and thereafter fasteners, such as self-drilling or self-punching fixings, may fix the extendable joists 12 onto the extendable bearers 16. Additionally or alternatively, the extendable beams 14 may be connected and fixed to the extendable bearers 16. Thereby, the assembler may set the overall size of the modular decking system 10 by extending or retracting the extendable joist(s) 12, the extendable beam(s) 14, and the extendable bearer(s) 16 relative to one another. The method 1000 may optionally include further steps of repeating any of the aforementioned steps for assembling more foundation units and/or decking modules and subsequently coupling them together to form a deck of any desired size (at block 1028).

Other embodiments, which differ from the aforementioned embodiments, may be recognized by those skilled in the art without departing from the following claims.

The invention claimed is:

1. A modular decking system, comprising:

at least one extendable joist;

at least two extendable beams each connected to the at least one extendable joist; and at least one extendable bearer supporting the at least one extendable joist and the at least two extendable beams, and the at least one extendable bearer is connected to the at least one extendable joist, wherein each extendable joist, each extendable beam, and each extendable bearer are extendable and retractable relative to one another, wherein each extendable beam comprises at least one locating member configured to locate and receive the at least one extendable joist therein, and wherein each locating member of each extendable beam comprises a cutout in the extendable beam.

2. The modular decking system of claim 1, wherein each extendable joist, each extendable beam, and each extendable bearer are configured to move relative to one another for setting an overall size of the modular decking system.

3. The modular decking system 1, wherein each extendable joist, each extendable beam, and each extendable bearer are configured to define an overall size of the modular decking system without cutting or drilling by an assembler.

4. The modular decking system of claim 1, wherein the at least one extendable joist comprises a first joist member and a second joist member disposed within and movable relative to the first joist member, and the second joist member is configured for extending a length of the at least one extendable joist.

5. The modular decking system of claim 4, wherein the second joist member comprises a first-joist-member facing surface and a joist recessed channel in the first-joist-member facing surface, and the joist recessed channel is configured to reduce friction between the second joist member and the first joist member.

6. The modular decking system of claim 1, wherein the at least two extendable beams each comprise a first beam member and a second beam member disposed within and movable relative to the first beam member, and the second beam member is configured for extending a length of each extendable beam.

7. The modular decking system of claim 6, wherein the second beam member comprises a first-beam-member facing surface and a beam recessed channel in the first-beam-member facing surface, and the beam recessed channel is configured to reduce friction between the second beam member and the first beam member.

8. The modular decking system of claim 1, wherein the at least one extendable bearer comprises a first bearer member and a second bearer member disposed within and movable relative to the first bearer member, and the second bearer member is configured for extending a length of the at least one extendable bearer.

9. The modular decking system of claim 8, wherein the second bearer member comprises a first-bearer-member facing surface and a bearer recessed channel in the first-bearer-member facing surface, and the bearer recessed channel is configured to reduce friction between the second bearer member and the first bearer member.

10. The modular decking system of claim 1, further comprising at least one extendable post configured to be fixed to the ground, the at least one extendable post is connected to the at least one extendable bearer.

11. The modular decking system of claim 10, wherein the at least one extendable post comprises a first post member fixed to the ground and a second post member disposed within and movable relative to the first post member.

12. The modular decking system of claim 11, wherein the second post member comprises a first-post-member facing surface and a post recessed channel in the first-post-member facing surface, and the post recessed channel is configured to reduce friction between the second post member and the first post member.

13. A method, comprising:

providing a modular decking system comprising at least one extendable joist, at least two extendable beams, and at least one extendable bearer, connecting the at least one extendable joist to each extendable beam;

connecting the at least one extendable joist to the at least one extendable bearer such that the at least one extendable bearer supports the at least one extendable joist and the at least two extendable beams; and setting an overall size of the modular decking system by extending or retracting each extendable joist, each extendable beam, and each extendable bearer relative to one another.

* * * * *